United States Patent [19]

McCrackin

[11] Patent Number: 4,863,218

[45] Date of Patent: Sep. 5, 1989

[54] ARTICULATED HEADREST MECHANISM

[75] Inventor: Hugh J. McCrackin, Pineville, N.C.

[73] Assignee: Pelton & Crane, Charlotte, N.C.

[21] Appl. No.: 296,915

[22] Filed: Jan. 12, 1989

Related U.S. Application Data

[63] Continuation of Ser. No. 233,966, Aug. 18, 1988, abandoned, which is a continuation of Ser. No. 164,164, Mar. 4, 1988, abandoned.

[51] Int. Cl.[4] ..... A47C 7/10

[52] U.S. Cl. ..... 297/39.1; 297/61; 297/408; 297/409

[58] Field of Search ..... 297/405, 409, 430, 391, 297/61, 68; 284/7; 254/389

[56] References Cited

U.S. PATENT DOCUMENTS

| | | | |
|---|---|---|---|
| 3,057,657 | 10/1962 | Fletcher | 297/61 |
| 3,817,576 | 6/1974 | Ciavattoni et al. | 297/408 |
| 4,353,595 | 10/1982 | Kaneko et al. | 297/408 |
| 4,413,858 | 11/1983 | Beach | 297/391 X |
| 4,511,180 | 4/1985 | Klaus | 297/408 |
| 4,515,406 | 5/1985 | Fujiyama et al. | 297/409 |
| 4,647,108 | 3/1987 | Hayashi | 297/391 |
| 4,674,797 | 1/1987 | Tateyama | 297/408 |
| 4,761,034 | 8/1988 | Saito | 297/408 |

FOREIGN PATENT DOCUMENTS

| | | |
|---|---|---|
| 2541506 | 3/1977 | Fed. Rep. of Germany . |
| 2932344 | 2/1981 | Fed. Rep. of Germany . |
| 3048688 | 9/1981 | Fed. Rep. of Germany . |

*Primary Examiner*—James T. McCall

*Attorney, Agent, or Firm*—Lawrence C. Edelman

[57] ABSTRACT

A headrest tilting mechanism includes a bar having first and second ends, with a headrest mounting portion proximate the first end and a substantially straight portion proximate the second end. A support means includes a curved cam surface and a pin having ends rotatably coupled to the support means. The pin has a cross-slot therethrough and a portion of the bar which is intermediate the first and second ends passes through the cross-slot. A cam following means attached to the bar proximate the second end causes the second end to follow the cam surface of the support means. With this arrangement, the curved cam surface is not located at the very top of the chair back and therefore the head of the patient can be significantly closer to the lap of the dentist than prior art arrangements.

22 Claims, 3 Drawing Sheets

ARTICULATED HEADREST MECHANISM

CROSS-REFERENCE TO RELATED APPLICATION

This is a continuation of Ser. No. 07/233,966 filed Aug. 18, 1988, which itself is a continuation of 07/164,164 filed Mar. 4, 1988, now abandoned.

BACKGROUND OF THE INVENTION

1. Field of the Invention

This invention relates to an articulated headrest for a treatment chair, and more particularly to a mechanism for controlling the tilting angle of the headrest of a dental treatment chair.

2. Description of the Prior Art

FIG. 1(A) indicates one type of prior art headrest mechanism for a dental chair wherein a headrest 2 includes a pad 4 fixedly attached to one end of a support bar 6, the other end of bar 6 being pivotably attached to the backrest 8 of the treatment chair via a coupling 10. The locus of rotation A of headrest 2 has a center of rotation C centered at coupling 10 while the locus of rotation B of the head H of a patient P has a center of rotation C′ corresponding with the cervical vertebrae of the patient P when positioned in the treatment chair. Since the center of rotation for headrest 2 does not match the center of rotation for head H, head H will physically slip out of position on pad 4 during adjustment of the tilt of headrest 2. This results in patient discomfort and a necessary repositioning of the posture of patient P.

FIG. 1(B) indicates another prior art headrest arrangement, such as known for example by U.S. Pat. No. 4,515,406, wherein the headrest mechanism 12 includes a pad 14 fixedly attached to a straight portion 16 of a generally curved support bar 18. The curved portion of support bar 18 rides between rollers 20 located within the backrest 22 of the dental chair and is thereby adjustable along the length of support bar 18 for controlling the tilting of the head H of the patient P. A locking ratchet arrangement 24 is included within backrest 22 and engages support bar 18 for locking it into a desired position. Note that in this arrangement the locus of rotation A of headrest pad 14 has a center of rotation C″ which is also the center of rotation of the head H of the patient P. Although this arrangement solves the problem shown in FIG. 1(A) of the head slipping off the headrest pad during adjustment of the tilting angle by having identical positions for origins C and C′, a disadvantage of this arrangement is that the curvature of support bar 18 prevents a significant lowering of the patient's head into the lap of the dentist since the curvature of support bar 18 is located at the top of the chair backrest. Thus, advantageous positioning of the head H of the patient P toward the top of the dentist is limited thereby.

An object of the present invention is to provide an adjustable headrest for a treatment chair which is comfortable for the patient both during and after a readjustment of the tilting of the patient's had and which improves the ability of the headrest to be lowered toward the lap of the dentist.

A further object of the invention is to provide a headrest mechanism which can easily be adjusted to a minor range of tilting angle which is separated from a main range of tilting angles.

SUMMARY OF THE INVENTION

In accordance with the principles of present invention, these objects are achieved by a mechanism which moves that portion of the headrest which defines its locus of rotation from the top of the chair backrest, to a position located lower in the backrest. More specifically, a bar is provided having first and second ends, with a headrest mounting portion proximate the first end and a substantially straight portion proximate the second end. A support means includes a curved cam surface and a pin having ends rotatably coupled to the support means. The pin has a cross-slot therethrough and a portion of the bar which is intermediate the first and second ends passes through the cross-slot. A cam following means attached to the bar proximate the second end causes the second end to follow the cam surface of the support means. With this arrangement, the curved cam surface is not located at the very top of the chair back and therefore the head of the patient can be significantly closer to the lap of the dentist than with the prior art arrangements.

Other features and advantages of the invention will be apparent from the description of the preferred embodiment, and from the claims.

For a fuller understanding of the present invention, reference should now be made to the following detailed description of the preferred embodiment of the invention and to the accompanying drawings.

DETAILED DESCRIPTION OF THE PREFERRED EMBODIMENT

Figure 1A:
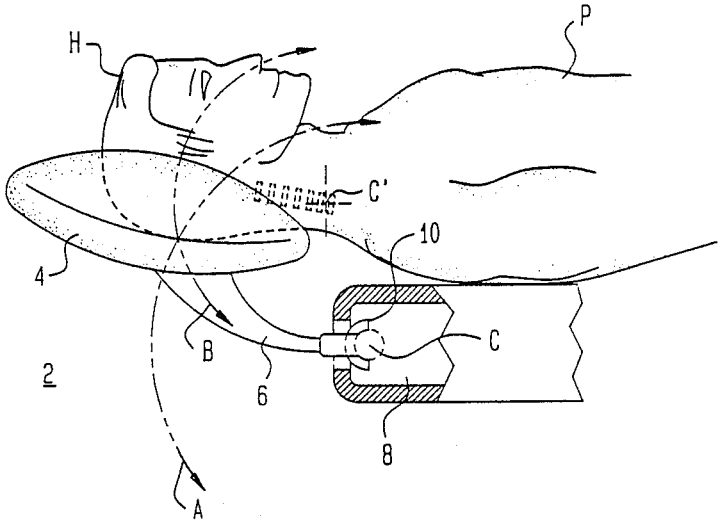
FIG. 1A (PRIOR ART)
FIGS. 1(A) and 1(B) show cross-section views of prior art headrest arrangements, previously described.
Figure 1B:
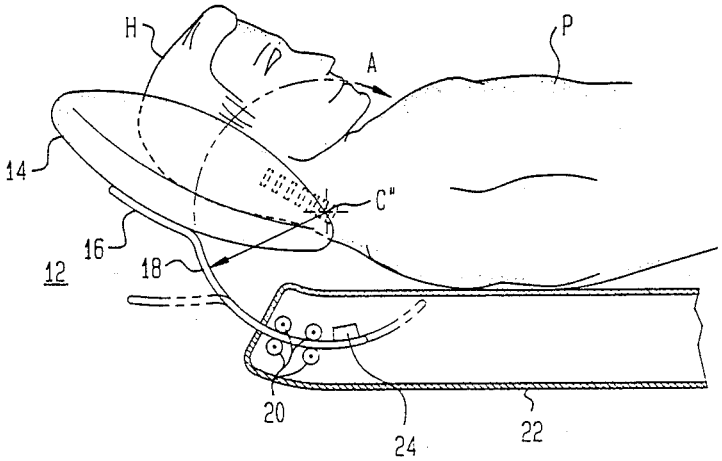
FIG. 1B (PRIOR ART)
Figure 2:
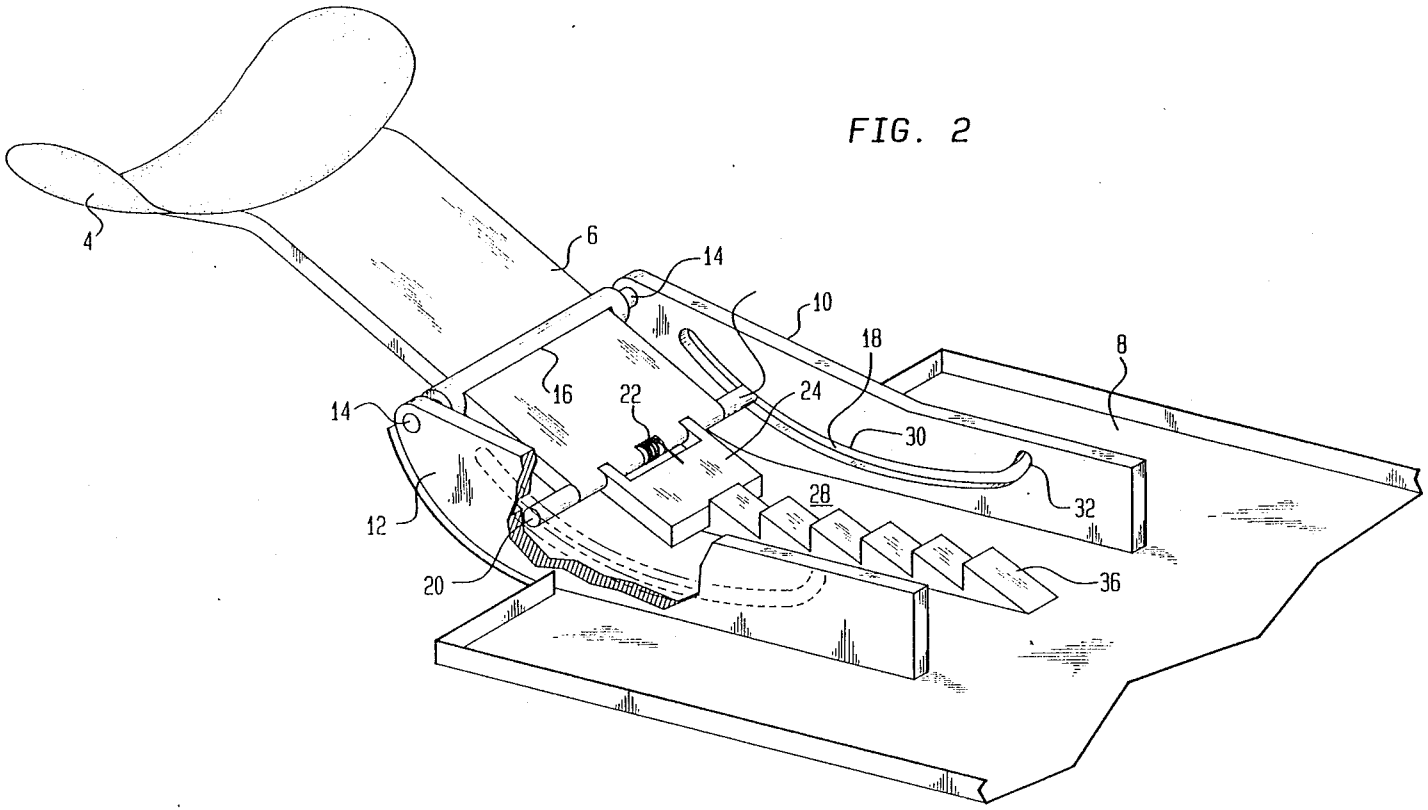
FIG. 2 shows a perspective view of a headrest arrangement constructed in accordance with the principles of the present invention.
Figure 3:
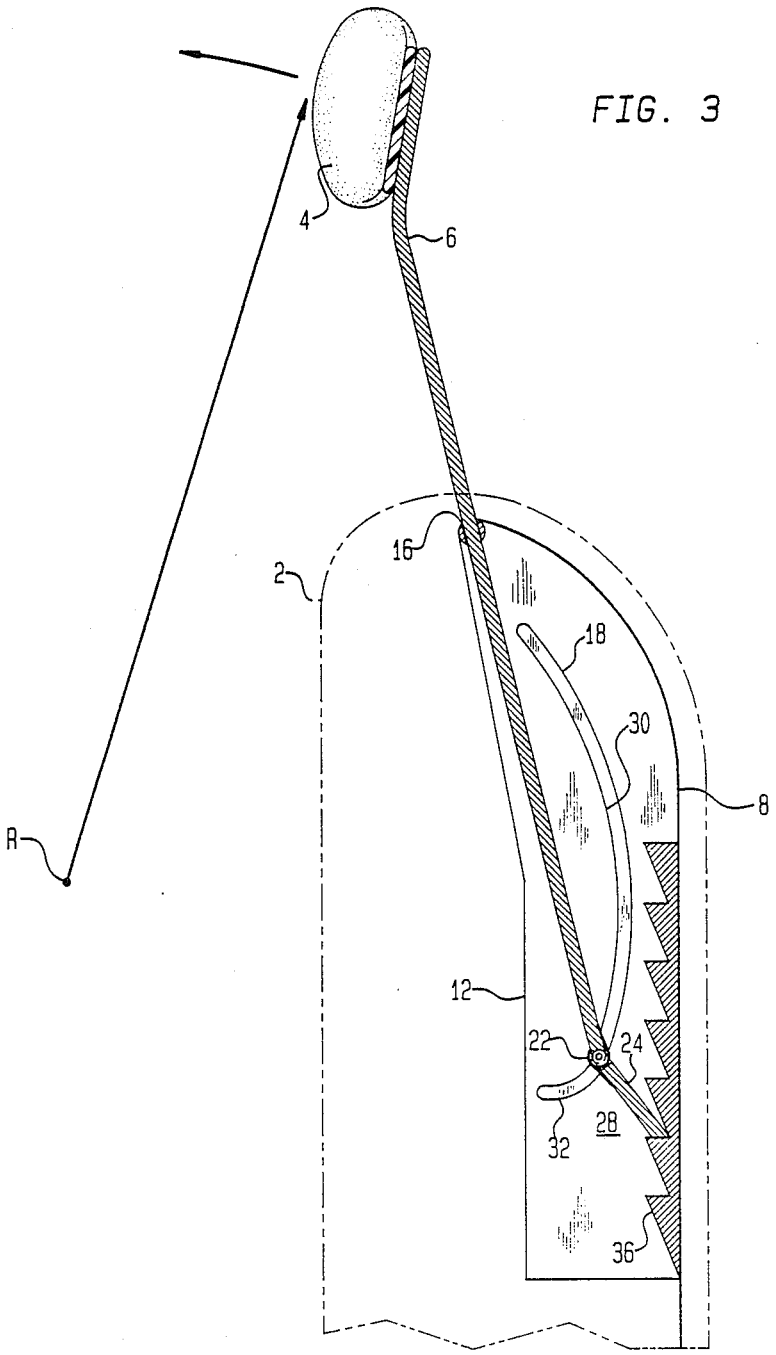
FIG. 3 shows a cross-section view of a headrest arrangement of FIG. 2.

FIGS. 2 and 3 illustrate perspective and section views, respectively, of a preferred embodiment of the headrest mechanism in a dental treatment chair. For purposes of clarity, the backrest portion 2 of the treatment chair (not totally shown) is shown in phantom without details of support, cushioning, etc., which details are not necessary for understanding the present invention.

A headrest pad 4 is attached to one end of a sliding support bar 6 which extends out the top of backrest 2 and is slidable therein. Support bar 6 has a curved portion wherein headrest pad 4 is attached and a substantially straight portion which extends into backrest 2. A mounting plate 8 secured within backrest 2 includes a support means for slidably positioning the other end of support bar 6 at various ones of plurality of fixed positions. The support means comprises cam plates 10 and 12 secured in a parallel facing relationship on mounting plate 8 and supported by a rotatable pin 14 having its ends captivated by a portion of cam plates 10 and 12 which is located toward headrest 4. Pin 14 has a cross-slot 16 located therethrough, through which the substantially straight portion of support bar 6 is able to slide through.

The facing sides of cam plates 10 and 12 include curved cam surfaces 18 therein, which slidably receive the ends of a cam following pin 20. Cam following pin 20 is secured near the end of support bar 6 which is opposite its headrest end. A spring 22 associated with pin 20 urges a pawl 24 against a bar 26 having serrations therein which engage pawl 24 to form a ratchet locking mechanism 28 which locks the position of support bar 6 into any one of a plurality of positions defined by the serrations on bar 26. A release cable (not shown) having an end attached to pawl 24 is accessable from the headrest end of backrest 2 for selectively releasing lock mechanism 28 from its present position and thereby allow repositioning of support bar 6.

In operation, support bar 6 slides through slot 16 in pin 14 as the position of headrest 4 is adjusted. Due to the confinement of the movement of the lower end of support bar 6 to a curved path defined by the action of cam following pin 20 along cam surfaces 18, headrest 4 moves in a curved path having a center of rotation R which is remote from the plane of mounting plate 8 and advantageously coincides with the center of rotation of the cervical vertebrae of a patient when disposed in the treatment chair. Thus, adjustment of the tilting angle of headrest 4 coincides with the normal angular movement of the patient's head and such adjustment is thereby accomplished without a sliding of the patient's head with respect to headrest 4.

Furthermore, in accordance with the present invention the curved surface which defines the tilting angle is located below the top of the chair back, thereby allowing the mechanical structure nearest the headrest to have a shape which will allow a maximum lowering of the patient's head towards the knees' of the dentist, thereby facilitating certain dental procedures.

In accordance with a further aspect of the invention, the curvature of cam surfaces 18 is divided into at least two portions. A first portion 30 comprises a uniformly shaped curved surface which controls a major portion of the movement of bar 18 and hence the tilting angle of headrest 4. A second portion 32 located at at least one end of first portion 28, comprises a surface having a curvature which is substantially different from the curvature of first portion 28, for allowing a range of tilting angles of headrest 4 which facilitates special dental procedures, such as those required during certain x-ray procedures.

Thus there has been shown and described novel apparatus for adjusting the tilting angle of a headrest which fulfills all the objects and advantages sought therefore. Many changes, modifications, variations and other uses and applications of the subject invention will, however, become apparent to those skilled in the art after considering this specification and the accompanying drawings which disclose only a preferred embodiment thereof. For example, although in the illustrated embodiment cam plates 10 and 12 are used, it is possible to use a single cam plate which is relatively thick so as to fully support pin 14 by only one end. Additionally, the substantially straight portion of support bar 6 which slides through slot 16 may be slightly curved, and that portion attached to headrest 4 may be advantageously curved so as to even further prevent interference with the knees of the dentist. Furthermore, the headrest tilting arrangement can be used in a treatment table, as well as in a treatment chair. All such changes, modifications, variations and other uses and applications which do not depart from the spirit and scope of the invention are deemed to be covered by the invention which is limited only by the following claims.

What I claim is:

1. A device for controlling an angle of tilting of a headrest of a human treatment support, comprising:

a bar having first and second ends, with a headrest mounting portion proximate said first end;

support means including at least one curved cam surface and a guide means, said guide means slidably engaging a portion of said bar which is intermediate said first and second ends so as to allow said bar to be slidable with respect to said support means; and cam following means attached to said bar proximate said second end for causing said second end to be engaged with and to follow said cam surface of said support means when said bar is slid with respect to said support means, thereby controlling the angle of tilting of said headrest mounting portion of said bar.

2. A device according to claim 1, wherein:

said guide means comprises a pin having an end rotatably coupled to said support means, said pin having a cross-slot therethrough with a portion of said bar intermediate said first and second ends passing through and being slidable within said cross-slot.

3. A device according to claim 1, wherein:

said guide means comprises a pin having an end rotatably coupled to said support means, said pin having a cross-slot therethrough with a portion of said bar intermediate said first and second ends passing through and being slidable within said cross-slot.

4. A device according to claim 2, further including:

lock means attached to said bar proximate said second end for preventing sliding motion of said bar through said cross-slot.

5. A device according to claim 4, wherein:

said support means comprises a substantially flat mounting plate having first and second cam plates mounted thereon in a spaced apart and parallel relationship.

6. A device according to claim 5, wherein:

first and second ends of said pin are adapted to rotatably engage said first and second cam plates, respectively.

7. A device according to claim 6, wherein:

a facing side of each of said cam plates include an elongated curved slot for forming said curved cam surface.

8. A device according to claim 7, wherein:

said cam follower comprises a pin attached to said second end of said bar, opposite ends of said pin adapted for engaging and following said cam surfaces of said cam plates, respectively.

9. A device according to claim 1, wherein:

a middle portion of said curved cam surface has a substantially uniform curvature for defining a substantial portion of the range of tilting of said headrest, and at least one end portion has a curvature which deviates from the substantially uniform curvature of said middle portion for causing said headrest to move within a locus of rotation which is different from the locus of rotation defined by said middle portion.

10. A device according to claim 2, wherein:

movement of said cam following means along said cam following surface causes said second portion of said bar to slide through said slot and said first portion of said bar to move along a curved path having an origin which is remote from said support means so as to be located at approximately the origin of the locus of rotation of the head of a patient to be positioned on said human treatment support.

11. A dental chair having an adjustable headrest, comprising:

a chair backrest;

a mounting plate fixedly attached within said chair backrest;

a bar having first and second ends, with a headrest mounting portion proximate said first end;

support means coupled to said mounting plate and including a curved cam surface and a guide means coupled to said support means, said guide means slidably engaging a portion of said bar which is intermediate said first and second ends so as to allow said bar to be slidable with respect to said support means; and cam following means attached to said bar proximate said second end for causing said second end to be engaged with and to follow said cam surface of said support means when said bar is slid with respect to said support means, thereby controlling the angle of tilting of said headrest mounting portion of said bar.

12. A device according to claim 3, further including:

lock means attached to said bar proximate said second end for preventing sliding motion of said bar through said cross-slot.

13. A device according to claim 12, wherein:

said support means includes first and second cam plates mounted on a substantially flat mounting plate in a spaced apart and parallel facing relationship.

14. A device according to claim 13, wherein:

first and second ends of said pin are adapted to rotatably engage said first and second cam plates, respectively.

15. A device according to claim 14, wherein:

each of said cam plates include an elongated curved slot for forming said curved cam surface.

16. A device according to claim 15, wherein:

said cam follower comprises a pin attached to said second end of said bar, opposite ends of said pin adapted for engaging and following said cam surfaces of said cam plates, respectively.

17. A device according to claim 11, wherein:

a middle portion of said curved cam surface has a substantially uniform curvature for defining a substantial portion of the range of tilting of said headrest, and at least one end portion has a curvature which deviates from the substantially uniform curvature of said middle portion for causing said headrest to move within a locus of rotation which is different from the locus of rotation defined by said middle portion.

18. A device according to claim 3, wherein:

movement of said cam following means along said cam following surface causes said second portion of said bar to slide through said slot and said first portion of said bar to move along a curved path having an origin which is remote from said support means so as to be located at approximately the origin of the locus of rotation of the head of a patient to be positioned on said dental chair support.

19. A device according to claim 1, wherein:

said bar includes a portion proximate said second end which is substantially straight.

20. A device according to claim 19, wherein:

said portion proximate said second end is substantially flat.

21. A device according to claim 11, wherein:

said bar includes a portion proximate said second end which is substantially straight.

22. A device according to claim 20, wherein said portion proximate said second end is substantially flat.

* * * * *